US006756009B2

(12) United States Patent
Sim et al.

(10) Patent No.: US 6,756,009 B2
(45) Date of Patent: Jun. 29, 2004

(54) METHOD OF PRODUCING HARDMETAL-BONDED METAL COMPONENT

(75) Inventors: Dong Sub Sim, Kyounggi-do (KR); Kyung Woon Kim, Incheon (KR); Keun Chul Song, Kyounggi-do (KR); Jung Hwan Cho, Seoul (KR)

(73) Assignee: Daewoo Heavy Industries & Machinery Ltd., Incheon (KR)

( * ) Notice: Subject to any disclaimer, the term of this patent is extended or adjusted under 35 U.S.C. 154(b) by 0 days.

(21) Appl. No.: 10/321,593

(22) Filed: Dec. 18, 2002

(65) Prior Publication Data

US 2003/0116227 A1 Jun. 26, 2003

(30) Foreign Application Priority Data

Dec. 21, 2001 (KR) ..... 10-2001-82636

(51) Int. Cl.[7] ..... B22F 7/04
(52) U.S. Cl. ..... 419/5; 419/8
(58) Field of Search ..... 419/5, 8; 228/193

(56) References Cited

U.S. PATENT DOCUMENTS 3,754,968 A * 8/1973 Reznik ..... 427/369
4,039,700 A * 8/1977 Sohmer et al. ..... 427/543
4,173,685 A * 11/1979 Weatherly ..... 428/556
4,280,841 A * 7/1981 Ito et al. ..... 419/6
4,750,667 A * 6/1988 Takahashi et al. ..... 228/178
4,950,557 A * 8/1990 Nakai et al. ..... 428/698
5,116,135 A * 5/1992 Kaiser et al. ..... 366/349
5,336,527 A * 8/1994 Takahashi et al. ..... 427/357
5,352,539 A * 10/1994 Psiuk ..... 428/558
6,200,524 B1 * 3/2001 Griskin et al. ..... 419/8
6,436,470 B1 * 8/2002 Iacocca et al. ..... 427/201

FOREIGN PATENT DOCUMENTS

JP A-62-182407 8/1987
JP A-62-185806 8/1987
WO WO 99/55470 * 11/1999

* cited by examiner

*Primary Examiner*—Ngoclan T. Mai
(74) *Attorney, Agent, or Firm*—Burns, Doane, Swecker & Mathis, L.L.P.

(57) ABSTRACT

A method is provided of producing a hardmetal-bonded metal component with an enhanced bond strength. The method comprises the steps of providing an iron-based metal body, mixing and compressing raw material powder of hardmetal and binder powder containing nickel, silicon and boron into a preform, heating and sintering the preform, and applying heat to the sintered body and the iron-based metal body under a state that the sintered body is brought into contact with the iron-based metal body, to thereby cause the sintered body to be bonded to the iron-based metal body. The sintered body and the iron-based metal body are thermally treated at a temperature of 1,000 to 1,200° C. for 30 or more minutes so that boron present in the sintered body is infiltrated into grain boundaries of the iron-based metal body to form a plurality of boride spikes in a bonding interface.

5 Claims, 2 Drawing Sheets

METHOD OF PRODUCING HARDMETAL-BONDED METAL COMPONENT

Priority is claimed to Korean Patent Application No. 2001-82636, filed Dec. 21, 2001, herein incorporated by reference.

BACKGROUND OF THE INVENTION

1. Field of the Invention

The present invention relates to a method of producing a hardmetal-bonded metal component, and more particularly, to a method of producing a hardmetal-bonded metal component excellent in wear and impact resistance by forming boride spikes in a bonding interface between hardmetal and an iron-based metal body to increase the bond strength therebetween.

2. Description of the Prior Art

Hardmetal comprises hard particles such as carbides including tungsten carbide and chromium carbide, nitrides or borides, and a metallic binder such as single metal including nickel and cobalt or alloy including nickel-based or cobalt-based alloy. By virtue of its excellent wear resistance, the hardmetal has been widely used in the field of tools and mechanical parts requiring high wear resistance.

In order for the hardmetal to be used as mechanical parts, it is generally bonded to a metal body such as iron-based alloy through the use of a brazing metal. In the meantime, the brazing metal should be excellent in bondability to both the hardmetal and the metal body to assure that the superhard alloy is bonded to the body with an increased strength. More particularly, the mechanical characteristics of the bonded component tend to be deteriorated due to the poor mechanical properties of the brazing metal itself.

To avoid such deficiency, a number of methods have been proposed of bonding hardmetal directly to a body without having to use any brazing metal. Japanese Patent Laid-Open Publication Nos. 62-182407 and 62-185806 disclose some of the direct bonding methods. However, mechanical components produced by way of such direct bonding techniques have a generally smooth bonding interface, which makes it difficult to increase the bond strength to above a certain limit. Furthermore, the direct bonding techniques cannot be employed in producing those wear-resistant parts which are frequently exposed to high surface pressure environment when in use.

Under the circumstances, there has been also proposed a method of forming, by machining, complementary protrusions and recesses on the bonding surfaces of the hardmetal sintered body and the metal body and then causing the sintered body and the metal body to be bonded together. This method poses a drawback that air voids are created in the bonding interface, thus resulting in a reduced bond strength.

SUMMARY OF THE INVENTION

Accordingly, the present invention is contemplated to solve the above and other shortcomings inherent in the prior art solutions and it is an object of the present invention to provide a method capable of bonding a superhard alloy preform to an iron-based metal body with a high bond strength and without having to use any brazing metal, thereby producing a hardmetal-bonded metal component which has an excellent wear and impact resistance.

According to an aspect of the present invention, there is provided a method of producing a hardmetal-bonded metal component, comprising the steps of: providing an iron-based metal body; mixing and compressing raw material powder of superhard alloy and binder powder containing nickel, silicon and boron into a preform; heating and sintering the preform; and applying heat to the sintered body and the iron-based metal body under a state that the sintered body is brought into contact with the iron-based metal body, to thereby cause the sintered body to be bonded to the iron-based metal body, wherein the sintered body and the iron-based metal body are thermally treated at a temperature of 1000 to 1200° C. for 30 or more minutes so that boron present in the sintered body is infiltrated into grain boundaries of the iron-based metal body, and have reaction with elements of metal body to form a plurality of boride spikes in a bonding interface.

The silicon and boron are preferably added in the amount of 2 to 6 wt % and 2 to 5 wt-%, respectively, on the basis of binder powder weight. Further, the raw material powder of hardmetal is preferably selected from the group consisting of carbides, nitrides and borides. Further, the duration time of the heat treatment preferably ranges from 60 to 100 minutes.

BRIEF DESCRIPTION OF THE DRAWINGS

The above and other objects and features of the present invention will become apparent from the following description of preferred embodiments given in conjunction with the accompanying drawings, in which.

DETAILED DESCRIPTION OF THE PREFERRED EMBODIMENTS

A preferred method of producing a hardmetal-bonded metal component according to the present invention will now be described in detail with reference to the accompanying drawings.

Figure 1:
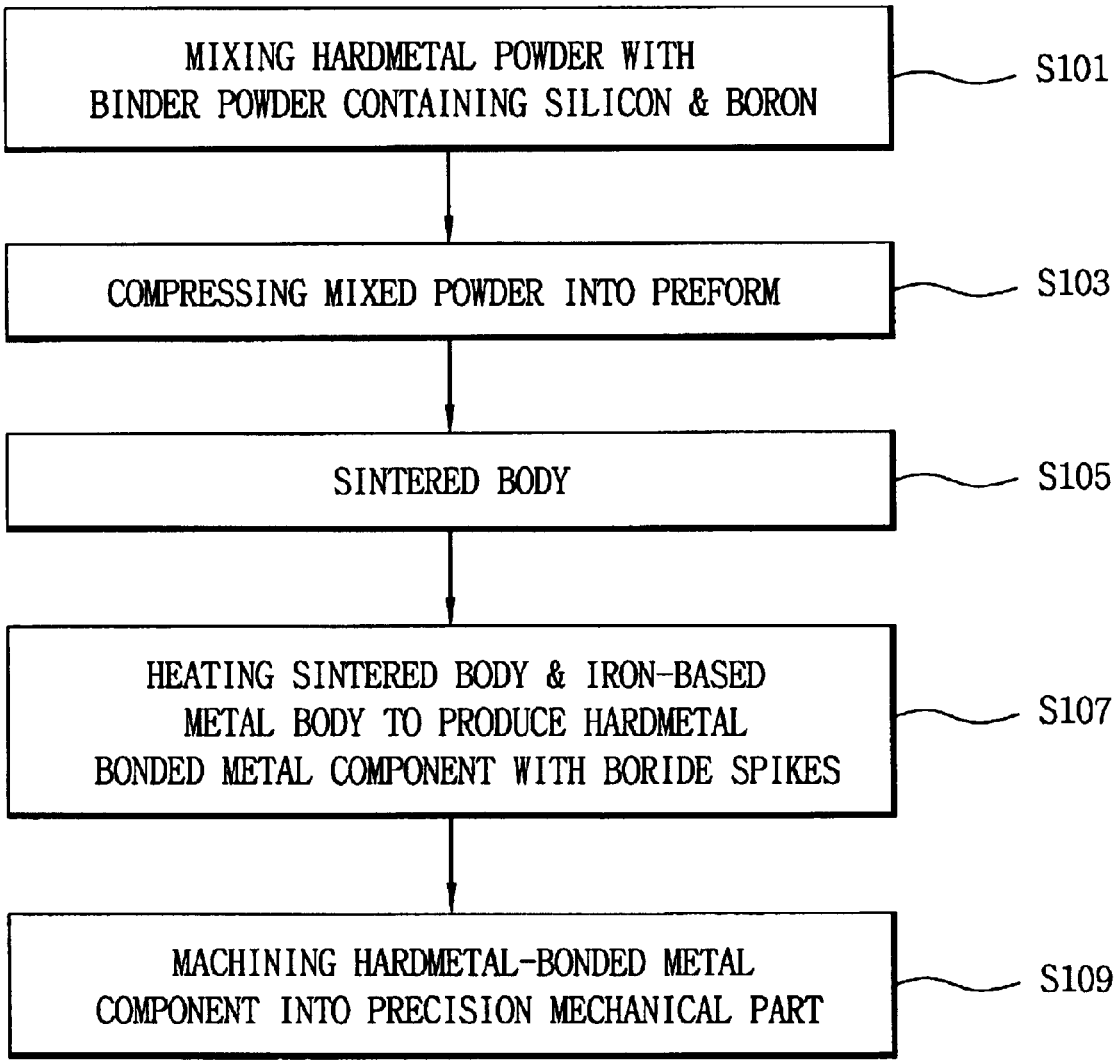
FIG. 1 is a flowchart illustrating a method of producing a superhard alloy-bonded metal component according to the present invention.

First, as shown in FIG. 1, the instant method comprises the step of preparing hard substance powder, which is the raw material of hardmetal, and then having this hardmetal powder mixed with binder powder (S101). It should be noted that the raw material powder of superhard alloy includes carbides, nitrides or borides, and further that the binder powder includes metal-based powder, for example, nickel-based or cobalt-based alloy. Silicon(Si) and boron(B) are added to the binder powder and serve to increase the bondability of a hardmetal preform to an iron-based body as set forth later.

In the meantime, it can be appreciated in Table 1 that silicon and boron are preferably added in the amount of 2 to 6 wt %, and 2 to 5 wt %, respectively, on the basis of binder powder weight. Such amount of addition of silicon and boron has been experimentally demonstrated to be optimum for the formation of boride spikes 32 in the bonding interface of the iron-based body 10. As is clear in Table 1, the shear strength of a bonded component with boron spikes 32 is as high as 453–512 kg/cm$^2$, which is far greater than the shear strength 173–201 kg/cm$^2$ of a bonded component with no boron spike.

TABLE 1

Binder Composition for Spike Formation

| | Ni (wt %) | Si (wt %) | B (wt %) | Bonding Tem. (° C.) | Spike Form. | Shear Strength (kg/cm$^2$) |
|---|---|---|---|---|---|---|
| Example 1 | Bal. | 1 | 3 | 1,100 | No | 173 |
| Example 2 | Bal. | 2 | 3 | 1,100 | Yes | 479 |
| Example 3 | Bal. | 5 | 3 | 1,000 | Yes | 457 |
| Example 4 | Bal. | 6 | 3 | 1,200 | Yes | 512 |
| Example 5 | Bal. | 7 | 3 | 1,200 | No | 201 |
| Example 6 | Bal. | 5 | 1 | 1,100 | No | 192 |
| Example 7 | Bal. | 5 | 2 | 1,100 | Yes | 476 |
| Example 8 | Bal. | 5 | 4 | 1,200 | Yes | 503 |
| Example 9 | Bal. | 5 | 5 | 1,000 | Yes | 453 |
| Example 10 | Bal. | 5 | 6 | 1,200 | No | 195 |

Referring again to FIG. 1, the present method further comprises the step of forming the mixed powder into a superhard alloy preform (S103) and pre-sintering the preform at a low temperature (S105). In the step S103, the mixed powder is compression-formed by a press. Then, in the sintering step S105, heat is applied to the preform to carry out the sintering at a low temperate. The sintering step S105 is performed at a temperature about 1,000° C. either in the atmosphere of inert gas or a mixture of reducing nitrogen and hydrogen gas, or a vacuum atmosphere.

Apart from the process of forming the sintered body, a metal body which is to be bonded to the sintered body is prepared by use of, e.g., iron-based alloy such as cast iron, carbon steel and alloy steel.

Then, the sintered hardmetal preform is brought into contact with the iron-based alloy body, after which the sintered body and the alloy body are subjected to thermal treatment so that bonding can occur therebetween (S107). In the heat treatment step S107, by applying heat to the contacted alloy body and sintered body, diffusion occurs between the alloy body and the sintered body.

Figure 2:
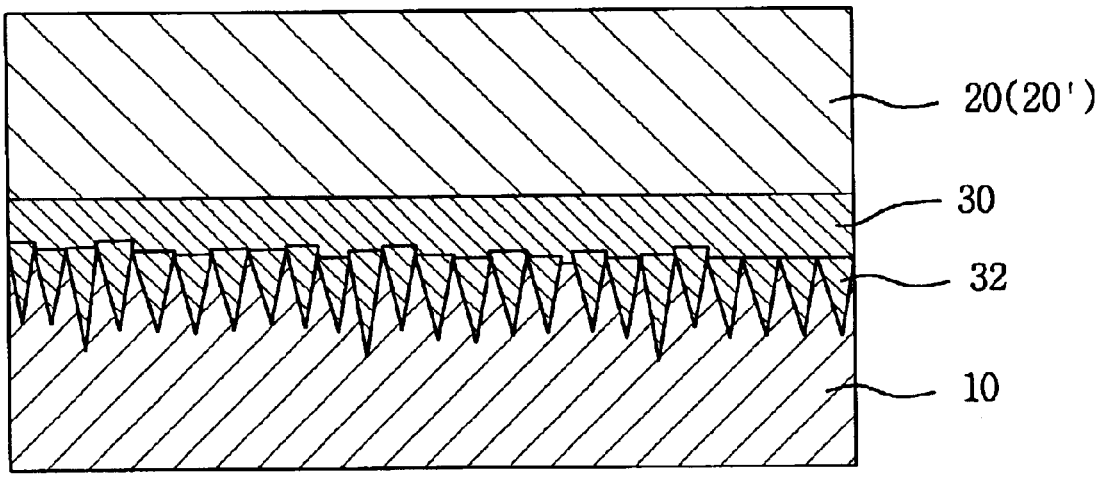
FIG. 2 is an enlarged sectional view schematically showing a section of the hardmetal-bonded metal component produced according to the inventive method.
Figure 3:
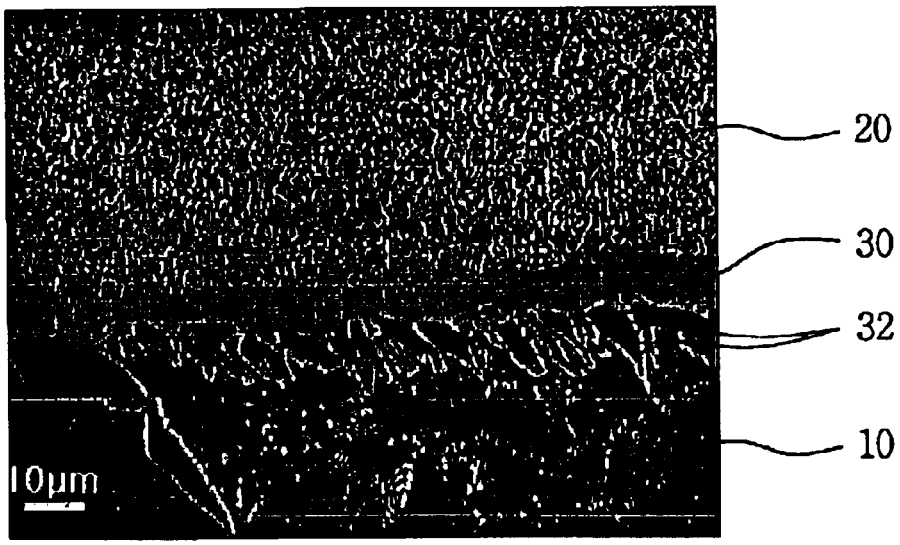
FIG. 3 is a microscopic photograph showing a section of the bonding interface between the superhard alloy and the iron-based alloy body produced according to the method of the present invention.

It is important to note that, in the heat treatment step S107, boride spikes are formed in the bonding interface between the body and the sintered body. That is, as the high temperature heat is applied to the contacted iron-based body and sintered body, a portion of boron present in the sintered body is rapidly infiltrated into the iron-based alloy body. At this time, the boron infiltration is made into the non-uniform portions of the iron-based alloy body, like grain boundaries. The boride spikes 32 so produced are of the shape as shown in FIGS. 2 and 3 and play a key role in increasing the contact area between the alloy body 10 and the sintered body 20' and thus improving the bond strength therebetween. Because the boride spikes 32 have the hardness of about 1,000 Hv, the bonded component can withstand a far greater shear load than the iron-based alloy body 10, the hardness of which is usually 300 Hv or so.

This step of heat treatment and bonding S107 is performed at a temperature of approximately 1,000 through 1,200° C. in an inert or reducing gas or vacuum atmosphere for 30 minutes, preferably 60 to 100 minutes. As can be seen from experimental results shown in Table 2, the heating temperature of 1,000–1,200° C. is most effective in forming the boride spikes 32 in the bonding interface 30 between the body 10 and the sintered body 20'. And the optimum duration time required for forming the boride spikes has been determined to be 60 to 100 minutes. Moreover, Table 2 shows that the shear strength of the bonded component so produced is as high as 385–508 kg/cm$^2$, which is more than twice greater than the shear strength 127–193 kg/cm$^2$ of a bonded component with no boride spikes.

TABLE 2

Bonding Temperature and Duration Time for Spike Formation

| | Ni (wt %) | Si (wt %) | B (wt %) | Bonding Time (° C.) | Dur. Spike (min.) | Spike Form. | Shear Strength (kg/cm$^2$) |
|---|---|---|---|---|---|---|---|
| Example 1 | Bal. | 5 | 3 | 1,250 | 30 | No | 193 |
| Example 2 | Bal. | 5 | 3 | 1,200 | 30 | Yes | 508 |
| Example 3 | Bal. | 3 | 5 | 1,200 | 30 | Yes | 501 |
| Example 4 | Bal. | 5 | 3 | 1,000 | 30 | Yes | 468 |
| Example 5 | Bal. | 2 | 5 | 1,000 | 30 | Yes | 438 |
| Example 6 | Bal. | 5 | 3 | 950 | 30 | No | 127 |
| Example 7 | Bal. | 3 | 5 | 1,100 | 5 | No | 132 |
| Example 8 | Bal. | 5 | 1 | 1,100 | 10 | Yes | 385 |
| Example 9 | Bal. | 5 | 2 | 1,100 | 30 | Yes | 481 |
| Example 10 | Bal. | 5 | 4 | 1,100 | 60 | Yes | 486 |
| Example 11 | Bal. | 5 | 5 | 1,100 | 70 | No | 186 |
| Example 12 | Bal. | 5 | 5 | 1,100 | 80 | No | 178 |

In the meantime, after the step of heat treatment and bonding S107 is completed, the bonded metal body and hardmetal (hereinafter, referred to as "hardmetal-bonded metal component") is slowly cooled at the room temperature, and the cooled hardmetal-bonded metal component is machined into a precision mechanical part (S109). In the machining step S109, the degree of precision of the hardmetal-bonded metal component is increased by way of machining and grounding the inner and outer surfaces thereof.

The hardmetal-bonded metal component produced through the aforementioned steps has a bonding interface structure as shown in FIGS. 2 and 3. Namely, in the step of heat treatment and bonding, the spikes 32 are formed in the bonding interface 30 between the hardmetal 20 and the iron-based alloy body 10, thus improving the bond strength to a great extent, which leads to an increased wear and impact resistance.

As described above, according to the method of producing the hardmetal-bonded metal component of the present invention, a plurality of boride spikes can be created in the bonding interface by properly controlling the composition of the wear-resistant superhard alloy, the heat treatment and bonding temperature, and the duration time of heat treatment. Consequently, the bond strength between the body and the wear-resistant hardmetal is increased, which results in greatly enhanced wear and impact resistance of the hardmetal-bonded metal component.

Although certain preferred embodiments of the present invention are described for illustrative purposes, the invention is not limited to the particular embodiments disclosed herein. It will be apparent to those skilled in the art that various changes or modifications may be made thereto within the scope of the invention defined by the appended claims.

What is claimed is:

1. A method of producing a hardmetal-bonded metal component, comprising the steps of:

providing an iron-based metal body;

mixing and compressing raw material powder of hardmetal and binder powder containing nickel, silicon and boron into a preform;

heating and sintering the preform; and applying heat to the sintered body and the iron-based metal body under a state that the sintered body is brought into contact with the iron-based metal body, to thereby cause the sintered body to be bonded to the iron-based metal body, wherein the sintered body and the iron-based metal body are thermally treated at a temperature of 1,000 to 1,200° C. for 30 or more minutes so that boron present in the sintered body is infiltrated into grain boundaries of the iron-based metal body to form a plurality of boride spikes in a bonding interface.

2. The method as recited in claim 1, wherein the silicon and boron are added in the amount of 2 to 6 wt % and 2 to 5 wt %, respectively, on the basis of binder powder weight.

3. The method as recited in claim 1, wherein the raw material powder of hardmetal is selected from the group consisting of carbides, nitrides and borides.

4. The method as recited in claim 2, wherein the raw material powder of hardmetal alloy is selected from the group consisting of carbides, nitrides and borides.

5. The method as recited in claim 1, wherein the duration time of the heat treatment ranges from 60 to 100 minutes.

* * * * *